US009796557B2

(12) United States Patent
Tanigawa et al.

(10) Patent No.: US 9,796,557 B2
(45) Date of Patent: Oct. 24, 2017

(54) BOBBIN UNWINDING DEVICE OF FILAMENT WINDING DEVICE

(75) Inventors: Motohiro Tanigawa, Kyoto (JP); Daigoro Nakamura, Kyoto (JP); Ken Hatta, Toyota (JP)

(73) Assignees: MURATA MACHINERY, LTD., Kyoto (JP); TOYOTA JIDOSHA KABUSHIKI KAISHA, Aichi (JP)

( * ) Notice: Subject to any disclaimer, the term of this patent is extended or adjusted under 35 U.S.C. 154(b) by 708 days.

(21) Appl. No.: 14/344,741

(22) PCT Filed: Sep. 13, 2012

(86) PCT No.: PCT/JP2012/073488
§ 371 (c)(1),
(2), (4) Date: Mar. 13, 2014

(87) PCT Pub. No.: WO2013/039155
PCT Pub. Date: Mar. 21, 2013

(65) Prior Publication Data

US 2014/0346271 A1 Nov. 27, 2014

(30) Foreign Application Priority Data

Sep. 16, 2011 (JP) ..... 2011-203680

(51) Int. Cl.
*B65H 57/14* (2006.01)
*B65H 57/18* (2006.01)
*B65H 49/18* (2006.01)

(52) U.S. Cl.
CPC ..... *B65H 57/14* (2013.01); *B65H 49/18* (2013.01); *B65H 57/18* (2013.01); *B65H 2701/31* (2013.01); *B65H 2701/37* (2013.01)

(58) Field of Classification Search
CPC ..... B65H 57/00; B65H 57/02; B65H 57/14; B65H 57/18; B65H 49/20; B65H 49/32;
(Continued)

(56) References Cited

U.S. PATENT DOCUMENTS 3,201,298 A * 8/1965 Baker ..... B21F 17/00 156/431
4,720,054 A 1/1988 Hood
(Continued)

FOREIGN PATENT DOCUMENTS

JP EP 0393420 A1 * 10/1990 ..... B65H 51/005
JP 09-052660 2/1997
(Continued)

OTHER PUBLICATIONS

EESR for corresponding application No. EP12831942.3 dated Mar. 18, 2015.
(Continued)

*Primary Examiner* — William E Dondero
*Assistant Examiner* — Nathaniel Adams
(74) *Attorney, Agent, or Firm* — DLA Piper LLP (US)

(57) ABSTRACT

This bobbin unwinding device (32A (32B)) is provided with a bobbin support shaft (33) which rotatably supports a bobbin (B) around which a band-like fiber bundle (F) is wound, a fixed guide (35) which changes the running direction of the fiber bundle (F) unwound from the bobbin (B), and an auxiliary roller (34) arranged between the bobbin (B) and the fixed guide (35), wherein the fixed guide (35) is arranged such that the shaft center of the fixed guide (35) is substantially perpendicular to the shaft center of the bobbin support shaft (33), and the auxiliary roller (34) is arranged such that the shaft center of the auxiliary roller (34) is parallel or substantially parallel to the shaft center of the bobbin support shaft (33).

8 Claims, 5 Drawing Sheets

(58) Field of Classification Search
CPC ..... B65H 51/005; B65H 51/02; B65H 51/04; B65H 51/12; B29C 53/64; B29C 53/66
See application file for complete search history.

(56) References Cited

U.S. PATENT DOCUMENTS

| | | | | |
|---|---|---|---|---|
| 5,501,411 | A | 3/1996 | Brum | |
| 6,311,377 | B1 | 11/2001 | Krueger | |
| 2009/0314872 | A1* | 12/2009 | Uozumi | B29C 53/8016 242/410 |

FOREIGN PATENT DOCUMENTS

| | | | |
|---|---|---|---|
| JP | H10-317252 | A | 12/1998 |
| JP | 2005-262504 | | 9/2005 |
| JP | 2006-150829 | | 6/2006 |
| JP | 2008-156104 | | 7/2008 |
| JP | 2010-023481 | | 2/2010 |

OTHER PUBLICATIONS

International Preliminary Report on Patentability (Chapter I of the Patent Cooperation Treaty) dated Mar. 18, 2014 issued in corresponding PCT application PCT/JP2012/73488.
Written Opinion of the International Search Authority issued in corresponding PCT application PCT/JP2012/73488.
Japanese language international search report dated Oct. 9, 2012 and its English language translation issued in corresponding PCT application PCT/JP2012/073488 cites the foreign patent documents listed above.

* cited by examiner (4A)

(4B)

BOBBIN UNWINDING DEVICE OF FILAMENT WINDING DEVICE

CROSS REFERENCE TO RELATED APPLICATIONS

This application is a national stage of international application PCT/JP2012/073488, filed on Sep. 13, 2012, and claims the benefit of priority under 35 USC 119 of Japanese application 2011-203680, filed on Sep. 16, 2011, which are incorporated herein by reference.

TECHNICAL FIELD

The present invention relates to a technique for a bobbin unwinding device of a filament winding device.

BACKGROUND ART

Conventionally, a filament winding device which winds a band-like fiber bundle around the outer periphery of a liner has been known. The filament winding device is provided with a creel stand, and a plurality of bobbins around which the fiber bundle is wound are arranged in the creel stand (for example, see Patent Literature 1). With regard to the filament winding device, the fiber bundle is unwound from each bobbin arranged in the creel stand in the form of rollingly reeling-off type, whereby the fiber bundle is wound around the outer periphery surface of the liner.

In the case of such filament winding device, especially in the case of a multiple yarn supply type filament winding device, the fiber bundles reeled off from the plurality of bobbins have to be guided and simultaneously wound onto the liner. Therefore, the creel stand tends to be increased in size. As such, the fiber bundles unwound from the bobbins tend to be increased in running distance, and the fiber bundles unwound from the bobbins need to be guided while being bent thereby being arranged in appropriate traveling directions. Accordingly, in the case where the fiber bundles are guided while being bent to different directions relative to the unwinding direction in which the fiber bundles are unwound from the bobbins, the fiber bundles may be turned upside down by the effect of twisting action. That is to say, there is a possibility of turnover of the fiber bundle.

Specifically, as shown in FIG. 5, a fiber bundle F unwound from a bobbin B is twisted between the bobbin B and a fixed guide 45. A twisting angle of the fiber bundle F fluctuates depending on the traversing of the fiber bundle F. At the position where the fiber bundle F is unwound from the bobbin B, one side in the width direction of the fiber bundle F is defined as a1, and the other side in the width direction of the fiber bundle F is defined as a2, whereas at the position where the fiber bundle F is whipped to the fixed guide 45, one side in the width direction of the fiber bundle F is defined as b1, and the other side in the width direction of the fiber bundle F is defined as b2. In that case, a difference between a distance from a1 to b1 and a distance from a2 to b2 becomes maximum at positions in the vicinity of folding-back positions TL, TR of traversing due to the traversing of the fiber bundle F. Accordingly, there is the case that the behavior of the fiber bundle F becomes unstable, and there is a problem in which a possibility of turnover of the fiber bundle F increases. As such, there is the threat that the fiber bundle F might be wound around the liner in a twisted state, and that might cause degradation of quality and deterioration of strength of a product.

Furthermore, the tension applied to the fiber bundle F fluctuates depending on the traversing of the fiber bundle F. That is to say, since the zone distance from the bobbin B to the fixed guide 45 varies depending on the traversing of the fiber bundle F, the tension applied to the fiber bundle F fluctuates. Accordingly, there is the case that the behavior of the fiber bundle F becomes unstable, and there is a problem in which the possibility of turnover of the fiber bundle F increases.

PRIOR ART DOCUMENTS

Patent Literature

Patent Literature 1: the Japanese Patent Laid Open Gazette 2010-23481

SUMMARY OF THE INVENTION

Problems to Be Solved by the Invention

The present invention is made in order to solve the above-described problems. An object of the present invention is to provide a technique which can stabilize the behavior of a fiber bundle to prevent turnover of the fiber bundle.

Means for Solving the Problems

A first aspect of the present invention is a bobbin unwinding device including: a bobbin support shaft which rotatably supports a bobbin around which a fiber bundle is wound; a fixed guide which changes the running direction of the fiber bundle unwound from the bobbin; and an auxiliary roller arranged between the bobbin and the fixed guide. The fixed guide is arranged such that the longitudinal center axis of the fixed guide is substantially perpendicular to the longitudinal center axis of the bobbin support shaft. The auxiliary roller is arranged such that the longitudinal center axis of the auxiliary roller is parallel or substantially parallel to the longitudinal center axis of the bobbin support shaft.

A second aspect of the present invention is the bobbin unwinding device according to the first aspect, wherein the length of the auxiliary roller is substantially equal to the length of the bobbin in the longitudinal center axis direction.

A third aspect of the present invention is the bobbin unwinding device according to the first or the second aspect, wherein the fixed guide is disposed at a position shifted from a central position of a traverse width of the fiber bundle when the fiber bundle is unwound from the bobbin.

A fourth aspect of the present invention is the bobbin unwinding device according to the first to the third aspect wherein the auxiliary roller configures an outer periphery surface which is gradually reduced in outer diameter as progressing toward the end portion in the longitudinal center axis direction from the central part in the longitudinal center axis direction of the auxiliary roller.

A fifth aspect of the present invention is the bobbin unwinding device according to the first to the fourth aspect, wherein the auxiliary roller is disposed at a position at which a contact length between the auxiliary roller and the fiber bundle is longer than the width dimension of the fiber bundle by two or more times.

A sixth aspect of the present invention is the bobbin unwinding device according to the first to the fourth aspect, wherein the auxiliary roller is disposed at a position at which an angle formed by the trajectory of the fiber bundle led to the auxiliary roller from the bobbin and the trajectory of the fiber bundle led to the fixed guide from the auxiliary roller is set a value smaller than 90 degrees.

A seventh aspect of the present invention is the bobbin unwinding device according to the first to the sixth aspect, wherein the fixed guide is disposed at a position at which an angle formed by the trajectory of the fiber bundle led to the fixed guide from the auxiliary roller and the trajectory of the fiber bundle fed from the fixed guide is set a value greater than 90 degrees.

Effects of the Invention

The present invention exerts effects described below.

According to the first aspect, the fiber bundle would not twist between the bobbin and the auxiliary roller. Alternatively, the fiber bundle is twisted between the auxiliary roller and the fixed guide. As such, the grip force of the auxiliary roller to the fiber bundle is maintained. Accordingly, the behavior of the fiber bundle can be stabilized, and turnover of the fiber bundle can be prevented.

According to the second aspect, the fiber bundle would not twist between the bobbin and the auxiliary roller even at a position in the vicinity of folding-back position of traversing. Alternatively, the fiber bundle is twisted between the auxiliary roller and the fixed guide. As such, the grip force of the auxiliary roller to the fiber bundle is maintained. Accordingly, the behavior of the fiber bundle can be stabilized, and turnover of the fiber bundle can be prevented.

According to the third aspect, turnover of the fiber bundle at a position in the vicinity of one folding-back position of traversing can be suppressed. As such, a possibility of turnover of the fiber bundle can be reduced. Accordingly, the behavior of the fiber bundle can be stabilized, and turnover of the fiber bundle can be prevented.

According to the fourth aspect, the difference of distance due to the width of the fiber bundle is reduced even at the position in the vicinity of folding-back position of traversing. As such, twisting of the fiber bundle is suppressed. Accordingly, the behavior of the fiber bundle can be stabilized, and turnover of the fiber bundle can be prevented.

According to the fifth aspect, while the fiber bundle unwound from the bobbin is en route to the fixed guide, the fiber bundle is touched to the auxiliary roller for a long distance. As such, the grip force of the auxiliary roller to the fiber bundle increases. Accordingly, the behavior of the fiber bundle can be stabilized, and turnover of the fiber bundle can be prevented.

According to the sixth aspect, while the fiber bundle unwound from the bobbin is en route to the fixed guide, the fiber bundle is touched to the auxiliary roller for a long distance. As such, the grip force of the auxiliary roller to the fiber bundle increases. Accordingly, the behavior of the fiber bundle can be stabilized, and turnover of the fiber bundle can be prevented.

According to the seventh aspect, turnover of the fiber bundle at a position in the vicinity of one folding-back position of traversing can be suppressed. As such, a possibility of turnover of the fiber bundle can be reduced. Accordingly, the behavior of the fiber bundle can be stabilized, and turnover of the fiber bundle can be prevented.

DESCRIPTION OF NOTATIONS

Figure 1:
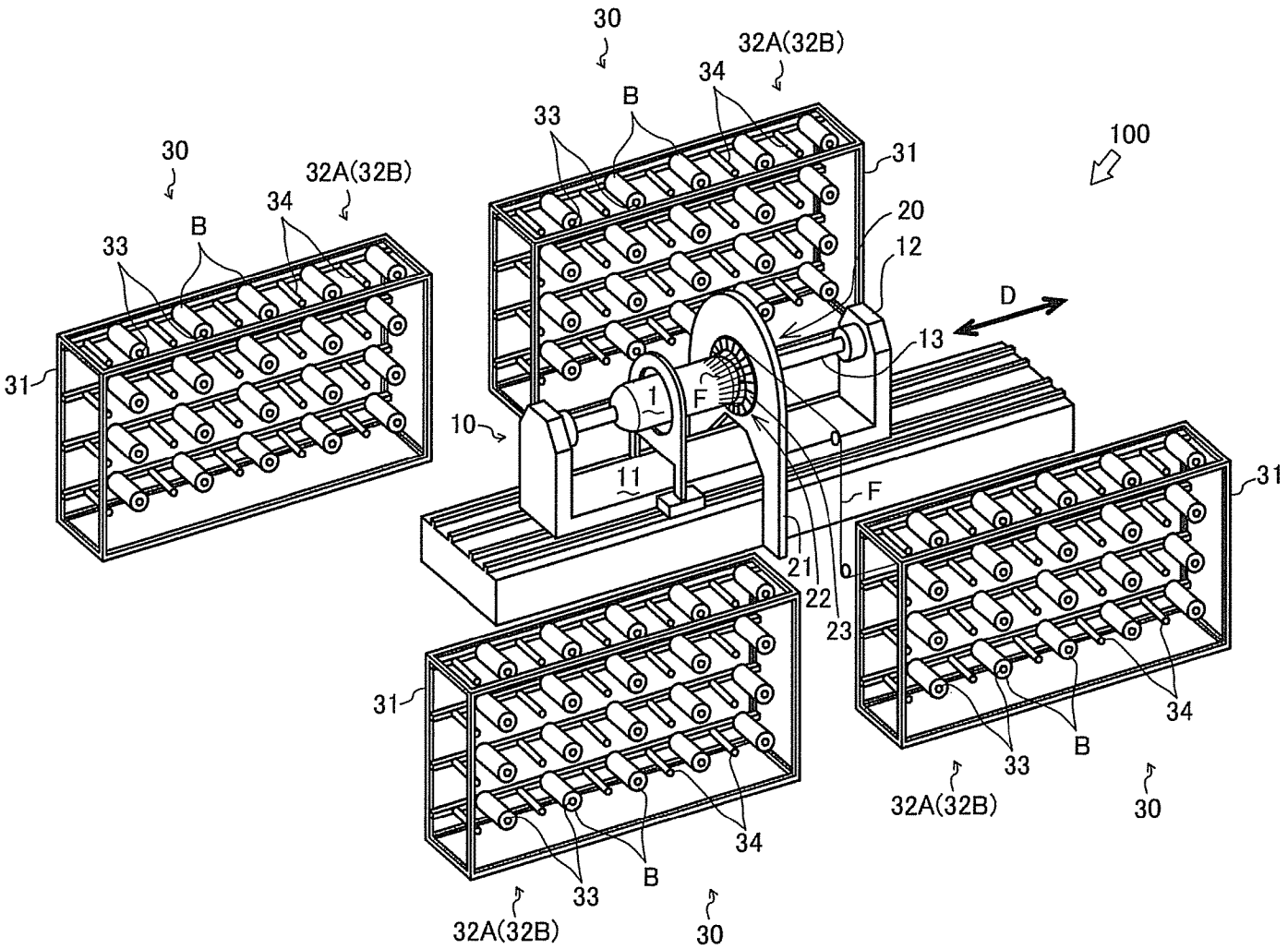
FIG. 1 illustrates an overall configuration of a filament winding device 100.

1 liner
10 liner transfer part
11 pedestal
12 liner support frame
13 rotational shaft
20 helical winding part
21 pedestal
22 helical head
23 nozzle
30 creel stand
31 rack
32A bobbin unwinding device
32B bobbin unwinding device
33 bobbin support shaft
34 auxiliary roller
35 fixed guide
B bobbin
F fiber bundle

DESCRIPTION OF EMBODIMENTS

Next, an explanation will be given of embodiments of the present invention.

Bobbin unwinding devices 32A (32B) according to an embodiment of the present invention are included in a filament winding device 100. Therefore, first of all, a brief explanation will be given of an overall configuration of the filament winding device 100 (Hereinafter referred to as "FW device 100")

FIG. 1 illustrates the overall configuration of the FW device 100. An arrow D in the drawing indicates a transfer direction of a liner 1. The direction in parallel to the transfer direction of the liner 1 is regarded as the longitudinal direction of the FW device 100, and one direction of transferring the liner 1 and other direction opposite thereto are respectively defined as the front side and the rear side. The FW device 100 reciprocates the liner 1 in the longitudinal direction, whereby the front side and the rear side is defined depending on the transfer direction of the liner 1.

The FW device 100 winds a fiber bundle F around the outer periphery surface of the liner 1. The FW device 100 mainly includes a liner transfer part 10, a helical winding part 20, and creel stands 30.

The liner transfer part 10 transfers the liner 1 while rotating it. In particular, the liner 1 is rotated about the longitudinal direction of the FW device 100 as a center axis, and is transferred in the longitudinal direction of the FW device 100 by the liner transfer part 10. The liner transfer part 10 mainly includes a pedestal 11, liner support frames 12, and a rotational shaft 13.

The pedestal 11 is placed on a pair of rails extending in the longitudinal direction of the FW device 100. The pedestal 11 is provided with the pair of liner support frames 12 and the rotational shaft 13. The liner 1 is attached to the rotational shaft 13 and is rotated one direction via a power mechanism (not shown).

Because of this configuration, it is possible that the liner 1 is rotated about the longitudinal direction of the FW device 100 as a center axis, and is transferred in the longitudinal direction of the FW device 100 by the liner transfer part 10.

The helical winding part 20 winds the fiber bundle F around the outer periphery surface of the liner 1. In particular, the helical winding part 20 performs so-called helical winding in which the winding angle of the fiber bundle F is set to be a prescribed value relative to the longitudinal direction of the FW device 100. The helical winding part 20 mainly includes a pedestal 21 and a helical head 22.

The pedestal 21 is provided with the helical head 22. The helical head 22 is provided with a plurality of nozzles 23 each of which guides the fiber bundle F. The fiber bundle F guided by each nozzle 23 is wound around the outer periphery surface of the liner 1 passing through while rotating.

Because of this configuration, it is possible that the helical winding part 20 performs so-called helical winding, where the winding angle of the fiber bundle F is set to be the prescribed value relative to the longitudinal direction of the FW device 100.

The creel stand 30 supplies the fiber bundles F to the helical winding part 20. In particular, the creel stand 30 supplies the fiber bundle F to each nozzle 23 of the helical head 22 included in the helical winding part 20. The creel stand 30 mainly includes a rack 31 and the bobbin unwinding devices 32A (32B). The bobbin unwinding device 32A (32B) mainly includes a bobbin support shaft 33, an auxiliary roller 34, and a fixed guide 35 (see FIG. 2).

The plurality of bobbin support shafts 33 and auxiliary rollers 34 are attached to the rack 31 such that the bobbin support shafts 33 and the auxiliary rollers 34 are in parallel to each other. Moreover, the fixed guides 35 are attached to the rack 31 such that the fixed guides 35 are perpendicular to the longitudinal center axis direction of the bobbin support shafts 33 (see FIG. 2). In a state that the fiber bundle F is pulled, a bobbin B supported by the bobbin support shaft 33 rotates, whereby the fiber bundle F is unwound (rollingly reeling-off type). And the fiber bundle F unwound from the bobbin B is led to the fixed guide 35 through the auxiliary roller 34, and then fed to the corresponding nozzle 23 through a plurality of guide members (not shown).

Because of this configuration, it is possible that the fiber bundle F is fed to each nozzle 23 of the helical head 22 included in the helical winding part 20 by the creel stand 30.

Next, a detailed explanation will be given of the bobbin unwinding device 32A which is a first embodiment of the present invention.

Figure 2:
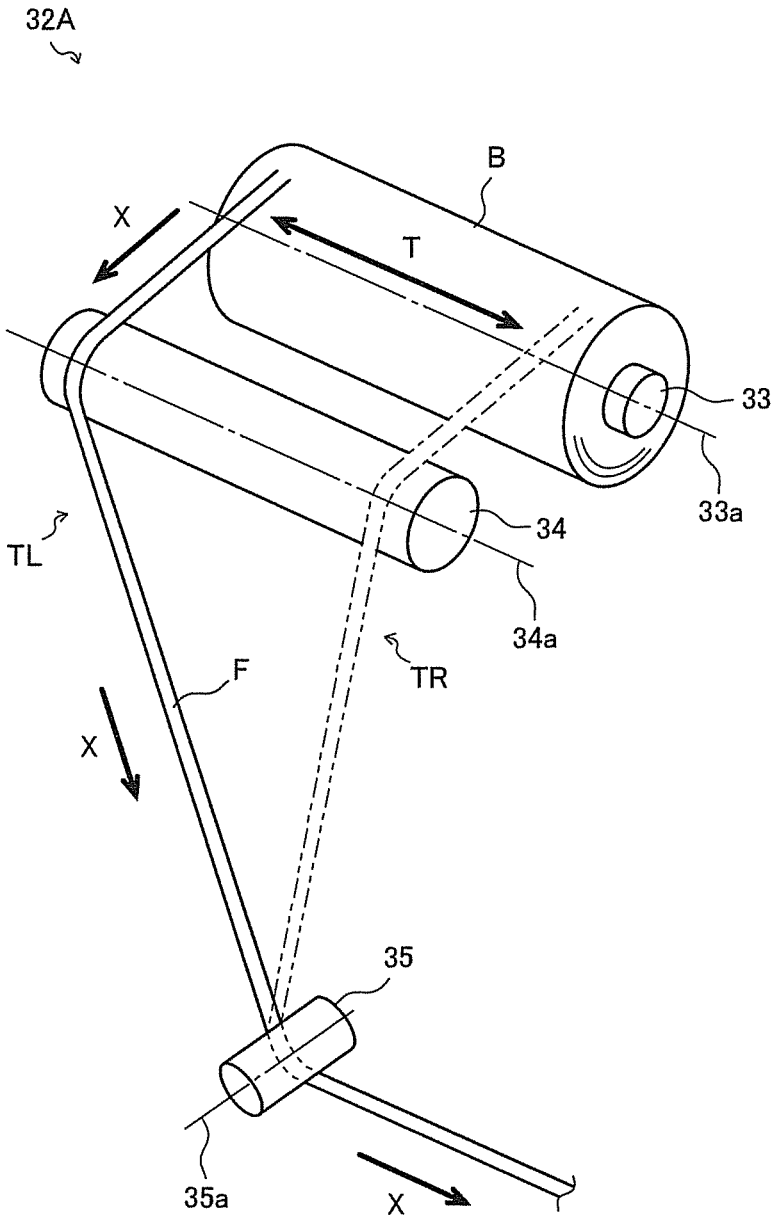
FIG. 2 illustrates a configuration of a bobbin unwinding device 32A according to a first embodiment of the present invention.

FIG. 2 shows the configuration of the bobbin unwinding device 32A according to the present embodiment. An arrow X shown in the drawing indicates the feeding direction of the fiber bundle B. An arrow T shown in the drawing indicates the traversing of the fiber bundle F when the fiber bundle F is unwound from the bobbin B.

The bobbin support shaft 33 is a support member which supports the bobbin B to be rotatable. The bobbin support shaft 33 is formed in an approximately cylindrical shape, and the bobbin support shaft 33 is fit into the bobbin B. As described above, the bobbin B supported by the bobbin support shaft 33 rotates in a state that the fiber bundle F is pulled, whereby the fiber bundle F is unwound (rollingly reeling-off type). And the fiber bundle F unwound from the bobbin B is led to the auxiliary roller 34.

The auxiliary roller 34 is a rotary member which guides the fiber bundle F to a prescribed direction. The auxiliary roller 34 is formed in an approximately cylindrical shape, and the fiber bundle F unwound from the bobbin B is whipped to the auxiliary roller 34. The auxiliary roller 34 is rotated by the fed fiber bundle F in a state where it is brought into contact with the auxiliary roller 34, whereby the fiber bundle F is guided to the prescribed direction. The fiber bundle F guided by the auxiliary roller 34 is then led to the fixed guide 35. Since the auxiliary roller 34 is arranged such that the longitudinal center axis 34*a* of the auxiliary roller 34 is parallel to the longitudinal center axis 33*a* of the bobbin support shaft 33, the fiber bundle F would not twist between the bobbin B and the auxiliary roller 34.

Moreover, since the fiber bundle F traverses (see the arrow T in FIG. 2) when the fiber bundle F is unwound from the bobbin B, the position at which the fiber bundle F is whipped to the auxiliary roller 34 changes in response to traversing. Therefore, the length of the auxiliary roller 34 is substantially equal to the length of the bobbin B in the longitudinal center axis direction (see FIG. 4B).

The fixed guide 35 is a rotary member which guides the fiber bundle F to a prescribed direction. The fixed guide 35 is formed in an approximately cylindrical shape, and the fiber bundle F guided by the auxiliary roller 34 is whipped to the fixed guide 35. The fixed guide 35 is rotated by the fed fiber bundle F in a state where it is brought into contact with the fixed guide 35, whereby the fiber bundle F is guided to the prescribed direction. And the fiber bundle F guided by the fixed guide 35 is led to the corresponding nozzle 23. Since the fiber bundle F guided by the auxiliary roller 34 is whipped to the fixed guide 35, the fiber bundle F is constrained in a constant path. Here, since the fixed guide 35 is arranged such that the longitudinal center axis 35*a* of the fixed guide 35 is perpendicular to the longitudinal center axis 33*a* of the bobbin support shaft 33, the fiber bundle F is twisted between the auxiliary roller 34 and the fixed guide 35.

Because of this configuration, with regard to the bobbin unwinding device 32A, the fiber bundle F would not twist between the bobbin B and the auxiliary roller 34 even at a position in the vicinity of folding-back position TL, TR of traversing. Alternatively, the fiber bundle F is twisted between the auxiliary roller 34 and the fixed guide 35. As such, the grip force of the auxiliary roller 34 is maintained. Accordingly, the behavior of the fiber bundle F can be stabilized, and turnover of the fiber bundle F can be prevented.

Next, a detailed explanation will be given of the bobbin unwinding device 32B which is a second embodiment of the present invention.

Figure 3:
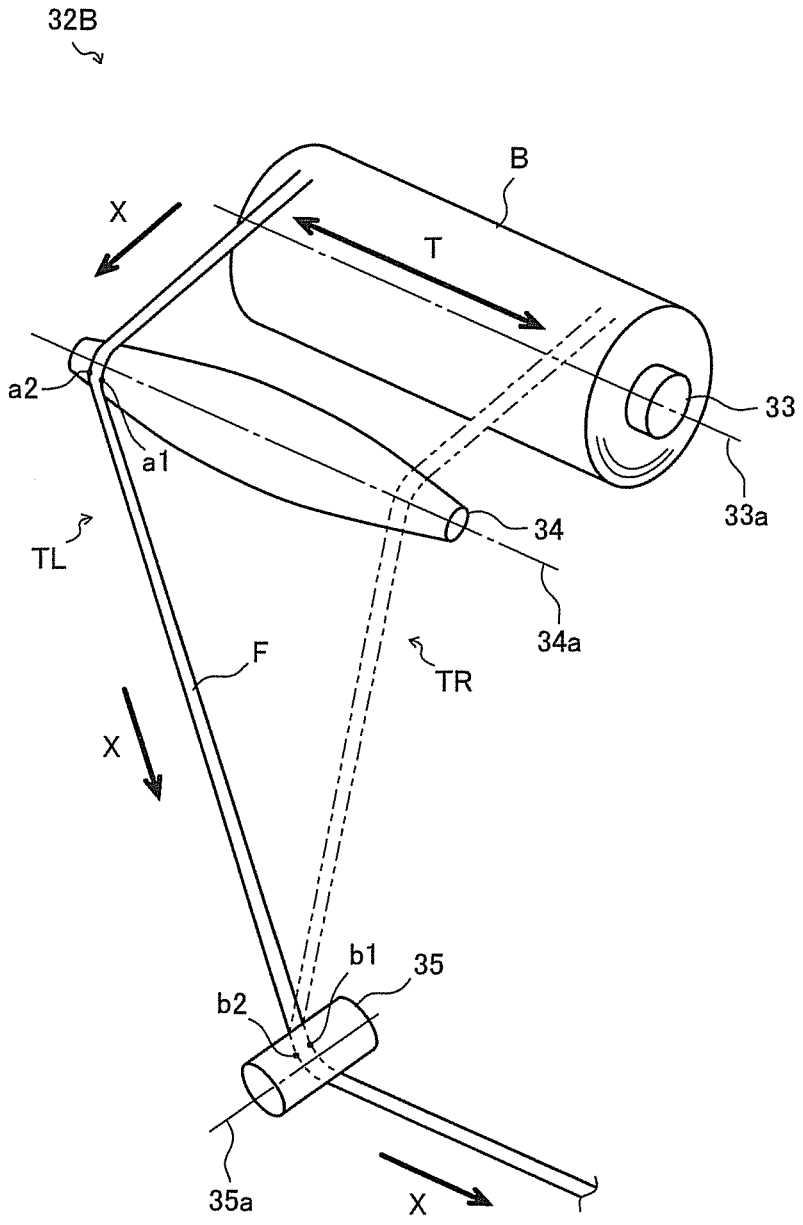
FIG. 3 illustrates a configuration of a bobbin unwinding device 32B according to a second embodiment of the present invention.

FIG. 3 shows the configuration of the bobbin unwinding device 32B according to the present embodiment. An arrow X shown in the drawing indicates the feeding direction of the fiber bundle F. An arrow T shown in the drawing indicates the traversing of the fiber bundle F when the fiber bundle F is unwound from the bobbin B.

The configuration of the bobbin unwinding device 32B according to the present embodiment is approximately the same as that of the above-mentioned bobbin unwinding device 32A according to the first embodiment. Accordingly, an explanation will be given focusing on differences relative to the bobbin unwinding device 32A of the first embodiment.

As shown in FIG. 3, an auxiliary roller 34 which is a member of the bobbin unwinding device 32B is formed in an approximately spindle shape. The auxiliary roller 34 configures an outer periphery surface which is gradually reduced in outer diameter as progressing toward the end portion in the longitudinal center axis direction from the central part in the longitudinal center axis direction of the auxiliary roller 34. The generatrix line of the cross section of the auxiliary roller 34 in the longitudinal center axis direction is formed in a convex curve from the shaft side. With regard to the bobbin unwinding device 32B, by using the auxiliary roller 34 formed in such shape, generation of twisting of the fiber bundle F between the auxiliary roller 34 and the fixed guide 35 is prevented, and turnover of the fiber bundle F is prevented.

Specifically, at the position where the fiber bundle F is unwound from the bobbin B, one side in the width direction of the fiber bundle F is defined as a1, and other side in the width direction of the fiber bundle F is defined as a2, whereas at the position where the fiber bundle F is whipped to the fixed guide 35, one side in the width direction of the fiber bundle F is defined as b1, and other side in the width direction of the fiber bundle F is defined as b2. In that case, a difference between a distance from a1 to b1 and a distance from a2 to b2 at the folding-back position TL, TR of traversing may become smaller than the case when the auxiliary roller 34 is formed in an approximately cylindrical shape (see FIG. 2). Accordingly, generation of twisting of the fiber bundle F between the auxiliary roller 34 and the fixed guide 35 can be suppressed, and the turnover of the fiber bundle F can be prevented.

Because of this configuration, with regard to the bobbin unwinding device 32B, the difference of distance due to the width of the fiber bundle F is reduced even at the position in the vicinity of folding-back position TL, TR of traversing. As such, twisting of the fiber bundle F is suppressed. Accordingly, the behavior of the fiber bundle F can be stabilized, and turnover of the fiber bundle F can be prevented.

Figure 4:
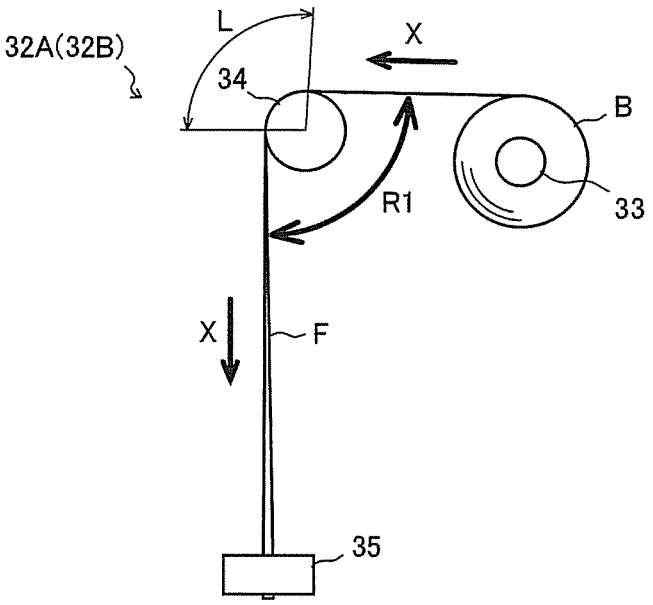
FIG. 4A is a front view illustrating the state where a fiber bundle F is unwound.
FIG. 4B is a side view illustrating the state where the fiber bundle F is unwound.
Figure 4:
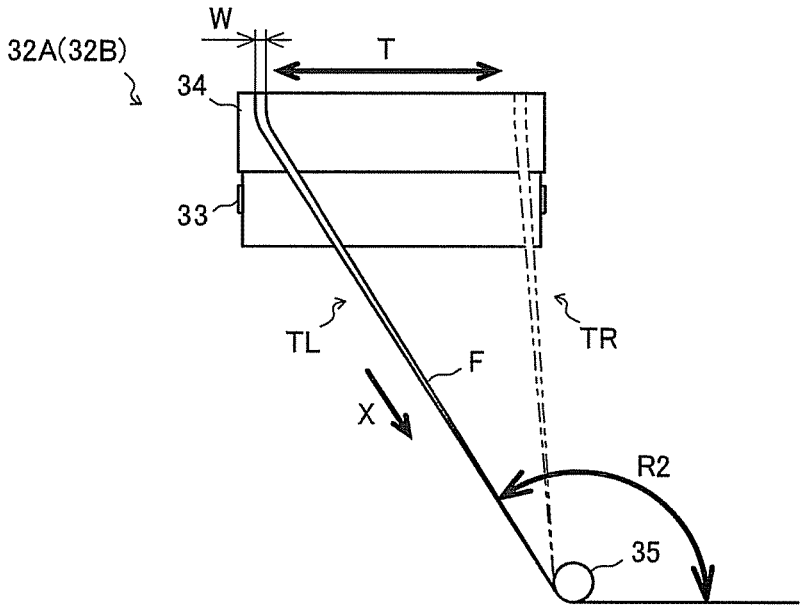
Figure 5:
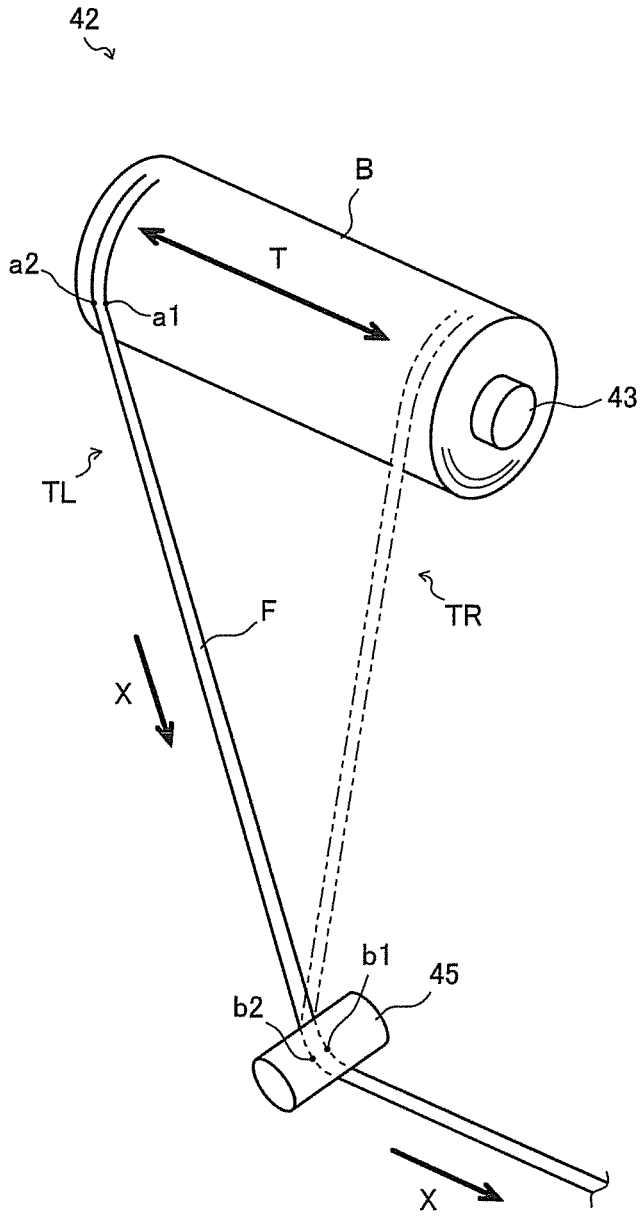
FIG. 5 illustrates a configuration of a bobbin unwinding device 42 according to a conventional embodiment.

Moreover, as shown in FIG. 4A and FIG. 4B, the auxiliary roller 34 which is a member of the bobbin unwinding device 32A (32B) is characterized in that the auxiliary roller 34 is disposed at a position at which the contact length between the auxiliary roller 34 and the fiber bundle F is longer than the width dimension of the fiber bundle F by two or more times. That is to say, a relation of following formula is satisfied, where L is the contact length between the auxiliary roller 34 and the fiber bundle F, and W is the width dimension of the fiber bundle F.

$$L>2W \qquad \text{Formula}$$

Because of this configuration, with regard to the bobbin unwinding device 32A (32B), while the fiber bundle F unwound from the bobbin B is en route to the fixed guide 35, the fiber bundle F is touched to the auxiliary roller 34 for a long distance. As such, the grip force of the auxiliary roller 34 to the fiber bundle F increases. Accordingly, the behavior of the fiber bundle F can be stabilized, and turnover of the fiber bundle F can be prevented.

As shown in FIG. 4A, the auxiliary roller 34 which is a member of the bobbin unwinding device 32A (32B) may be disposed at a position at which an angle formed by the trajectory of the fiber bundle F led to the auxiliary roller 34 from the bobbin B and the trajectory of the fiber bundle F led to the fixed guide 35 from the auxiliary roller 34 is set a value smaller than 90 degrees. That is to say, the bobbin unwinding device 32A (32B) is configured such that a relation of following formula is satisfied, where R1 is the angle formed by the trajectory of the fiber bundle F led to the auxiliary roller 34 from the bobbin B and the trajectory of the fiber bundle F led to the fixed guide 35 from the auxiliary roller 34.

$$R1<90^\circ \qquad \text{Formula}$$

Because of this configuration, with regard to the bobbin unwinding device 32A (32B), while the fiber bundle F unwound from the bobbin B is en route to the fixed guide 35, the fiber bundle F is touched to the auxiliary roller 34 for a long distance. As such, the grip force of the auxiliary roller 34 to the fiber bundle F increases. Accordingly, the behavior of the fiber bundle F can be stabilized, and turnover of the fiber bundle F can be prevented.

Furthermore, as shown in FIG. 4B, the fixed guide 35 which is a member of the bobbin unwinding device 32A (32B) is disposed at a position at which an angle formed by the trajectory of the fiber bundle F led to the fixed guide 35 from the auxiliary roller 34 and the trajectory of the fiber bundle F fed from the fixed guide 35 is set a value greater than 90 degrees. That is to say, a relation of following formula is satisfied, where R2 is the angle formed by the trajectory of the fiber bundle F led to the fixed guide 35 from the auxiliary roller 34 and the trajectory of the fiber bundle F fed from the fixed guide 35.

$$R2>90^\circ \qquad \text{Formula}$$

Because of this configuration, with regard to this bobbin unwinding device 32A (32B), turnover of the fiber bundle F at a position in the vicinity of one folding-back position TR of traversing can be suppressed. As such, a possibility of turnover of the fiber bundle F can be reduced. Accordingly, the behavior of the fiber bundle F can be stabilized, and turnover of the fiber bundle F can be prevented.

In more detail, the possibility of turnover of the fiber bundle F occurs only at a position in the vicinity of the other folding-back position TL of traversing. That is to say, a part of the fiber bundle F where turnover may occur is specified to the position nearby the folding-back position TL of traversing. Accordingly, a probability of turnover of the fiber bundle F is reduced to be approximately 50%.

INDUSTRIAL APPLICABILITY

The present invention can be utilized to a technique of a bobbin unwinding device of a filament winding device.

What is claimed is:

1. A bobbin unwinding device of a multiple fiber bundles supplying filament winding device in which a liner is rotated and wound on an outer periphery surface of the liner with fiber bundles, wherein the filament winding device comprises:

a liner transfer part, wherein the liner transfer part is configured to transfer and rotate the liner;

a helical winding part comprising a plurality of nozzles, wherein the helical winding part is configured to guide the fiber bundles around the outer periphery surface of the liner; and a creel stand comprising a plurality of bobbin unwinding devices, wherein the creel stand is configured to supply the fiber bundles to each of the nozzles of the helical winding part, wherein the plurality of bobbin unwinding devices each comprises:

a bobbin support shaft which rotatably supports a bobbin around which one of the fiber bundles is wound;

a fixed guide which is rotated by the fed fiber bundle and changes the running direction of the fiber bundle unwound from the bobbin; and an auxiliary roller arranged between the bobbin and the fixed guide, wherein the fixed guide is arranged such that a longitudinal center axis of the fixed guide is substantially perpendicular to the bobbin support shaft and changes the running direction of the fiber bundle to the direction which is parallel to the longitudinal center axis of the bobbin support shaft, the auxiliary roller is arranged such that the longitudinal center axis of the auxiliary roller is parallel or substantially parallel to the longitudinal center axis of the bobbin support shaft, the fixed guide is arranged under the auxiliary roller and perpendicular to the auxiliary roller, and the fiber bundle is twisted between the auxiliary roller and the fixed guide.

2. The bobbin unwinding device according to claim 1, wherein the length of the auxiliary roller is substantially equal to the length of the bobbin in a longitudinal center axis direction of the bobbin.

3. The bobbin unwinding device according to claim 1, wherein the fixed guide is disposed at a position shifted from a central position of a traverse width of the fiber bundle when the fiber bundle is unwound from the bobbin.

4. The bobbin unwinding device according to claim 1, wherein the auxiliary roller comprises an outer periphery surface which is gradually reduced in outer diameter as progressing toward the end portion in a longitudinal center axis direction from a central part in the longitudinal center axis direction of the auxiliary roller.

5. The bobbin unwinding device according to claim 1, wherein the auxiliary roller is disposed at a position at which a contact length between the auxiliary roller and the fiber bundle is longer than the width dimension of the fiber bundle by two or more times.

6. The bobbin unwinding device according to claim 1, wherein the auxiliary roller is disposed at a position at which an angle formed by a trajectory of the fiber bundle led to the auxiliary roller from the bobbin and the trajectory of the fiber bundle led to the fixed guide from the auxiliary roller is set a value smaller than 90 degrees.

7. The bobbin unwinding device according to claim 1, wherein the fixed guide is disposed at a position at which an angle formed by the trajectory of the fiber bundle led to the fixed guide from the auxiliary roller and the trajectory of the fiber bundle fed from the fixed guide is set a value greater than 90 degrees.

8. A bobbin unwinding device of a multiple fiber bundles supplying filament winding device in which a liner is rotated and wound on an outer periphery surface of the liner with fiber bundles, wherein the filament winding device comprises:

a liner transfer part, wherein the liner transfer part is configured to transfer and rotate the liner;

a helical winding part comprising a plurality of nozzles, wherein the helical winding part is configured to guide the fiber bundles around the outer periphery surface of the liner; and a creel stand comprising a plurality of bobbin unwinding devices, wherein the creel stand is configured to supply the fiber bundles to each of the nozzles of the helical winding part, wherein the plurality of bobbin unwinding devices each comprises:

a bobbin support shaft which rotatably supports a bobbin around which one of the fiber bundles is wound;

a fixed guide which is rotated by the fed fiber bundle and changes the running direction of the fiber bundle unwound from the bobbin; and an auxiliary roller arranged between the bobbin and the fixed guide, wherein the fixed guide is arranged such that the longitudinal center axis of the fixed guide is substantially perpendicular to the longitudinal center axis of the bobbin support shaft, is disposed at a position shifted from a central position of a traverse width of the fiber bundle when the fiber bundle is unwound from the bobbin, is disposed at a position at which an angle formed by the trajectory of the fiber bundle led to the fixed guide from the auxiliary roller and the trajectory of the fiber bundle fed from the fixed guide is set a value greater than 90 degrees, and changes the running direction of the fiber bundle to the direction which is parallel to the longitudinal center axis of the bobbin support shaft, and wherein the auxiliary roller is arranged such that the longitudinal center axis of the auxiliary roller is parallel or substantially parallel to the longitudinal center axis of the bobbin support shaft, the fixed guide is arranged under the auxiliary roller and perpendicular to the auxiliary roller, and the fiber bundle is twisted between the auxiliary roller and the fixed guide.

* * * * *